US009427067B2

(12) United States Patent
Satterfield

(10) Patent No.: US 9,427,067 B2
(45) Date of Patent: Aug. 30, 2016

(54) TOOL BELT

(71) Applicant: Joseph Allen Satterfield, Medford, OR (US)

(72) Inventor: Joseph Allen Satterfield, Medford, OR (US)

( * ) Notice: Subject to any disclaimer, the term of this patent is extended or adjusted under 35 U.S.C. 154(b) by 163 days.

(21) Appl. No.: 14/450,619

(22) Filed: Aug. 4, 2014

(65) Prior Publication Data

US 2016/0029774 A1 Feb. 4, 2016

Related U.S. Application Data

(60) Provisional application No. 61/985,857, filed on Apr. 29, 2014.

(51) Int. Cl.
*A45F 3/00* (2006.01)
*A45F 5/02* (2006.01)

(52) U.S. Cl.
CPC ..... *A45F 3/005* (2013.01); *A45F 5/021* (2013.01); *A45F 2200/0575* (2013.01)

(58) Field of Classification Search
CPC ..... A45F 3/005; A45F 5/021; A45F 2200/0575; A45F 5/00; A45F 5/02; A45F 5/022; Y10S 224/904; Y10S 150/90; A45C 13/06; B65D 33/30; B65D 33/02
USPC ..... 224/660
See application file for complete search history.

(56) References Cited

U.S. PATENT DOCUMENTS

| | | | | |
|---|---|---|---|---|
| 2,040,271 | A * | 5/1936 | Rosenzweig | A45C 13/06 150/118 |
| 5,067,643 | A * | 11/1991 | McKinney | A45F 5/00 224/197 |
| 5,609,419 | A * | 3/1997 | Byers, Jr. | A45C 13/06 224/674 |
| 5,639,003 | A | 6/1997 | Utzinger | |
| 5,649,623 | A | 7/1997 | Kornblatt | |
| 5,680,026 | A | 10/1997 | Lueschen | |
| 5,743,451 | A | 4/1998 | Kahn | |
| 5,813,530 | A | 9/1998 | Kornblatt | |
| 5,988,315 | A | 11/1999 | Crane | |
| 6,390,348 | B1 * | 5/2002 | Godshaw | A45F 5/00 224/660 |
| 6,435,389 | B1 | 8/2002 | Sucher | |
| 6,701,534 | B2 | 3/2004 | Guibord | |
| 6,848,605 | B2 | 2/2005 | Dillenberger | |
| 7,011,241 | B2 | 3/2006 | Godshaw | |
| D658,852 | S | 5/2012 | McCoy | |
| 8,220,683 | B2 | 7/2012 | Williams | |
| 8,919,629 | B2 | 12/2014 | Moreau | |
| 2004/0178240 | A1 | 9/2004 | Bauer | |
| 2006/0102674 | A1 | 5/2006 | Godshaw | |
| 2007/0006367 | A1 | 1/2007 | Newman | |
| 2008/0023515 | A1 | 1/2008 | Coonan | |
| 2009/0145789 | A1 | 6/2009 | Panosian et al. | |
| 2012/0138623 | A1 * | 6/2012 | Verma | B65D 33/1658 220/810 |
| 2013/0008933 | A1 | 1/2013 | Clifford | |
| 2014/0353352 | A1 | 12/2014 | Shapiro | |

FOREIGN PATENT DOCUMENTS

WO 8803461 A1 5/1988

* cited by examiner

*Primary Examiner* — Adam Waggenspack
(74) *Attorney, Agent, or Firm* — Chernoff Vilhauer McClung & Stenzel, LLP

(57) ABSTRACT

A tool belt assembly includes a spring assembly and a bag.

20 Claims, 20 Drawing Sheets

TOOL BELT

CROSS-REFERENCE TO RELATED APPLICATIONS

This application claims the benefit of U.S. Provisional App. No. 61/985,857, filed Apr. 29, 2014.

TECHNICAL FIELD

The present disclosure relates generally to a tool belt.

BACKGROUND OF THE INVENTION

Construction workers, tradesmen, and the like typically use a tool belt attached about their waist to transport to and maintain tools and supplies at a worksite. Such belts are often fabricated from leather and include a number of pockets which are designed to hold tools such as pliers, screwdrivers, screws, nails, and the like. Desirable characteristics of such belts are durability and the capability hold and store many such tools.

The foregoing and other objectives, features, and advantages of the invention will be more readily understood upon consideration of the following detailed description of the invention, taken in conjunction with the accompanying drawings.

DETAILED DESCRIPTION OF PREFERRED EMBODIMENT

Figure 1:
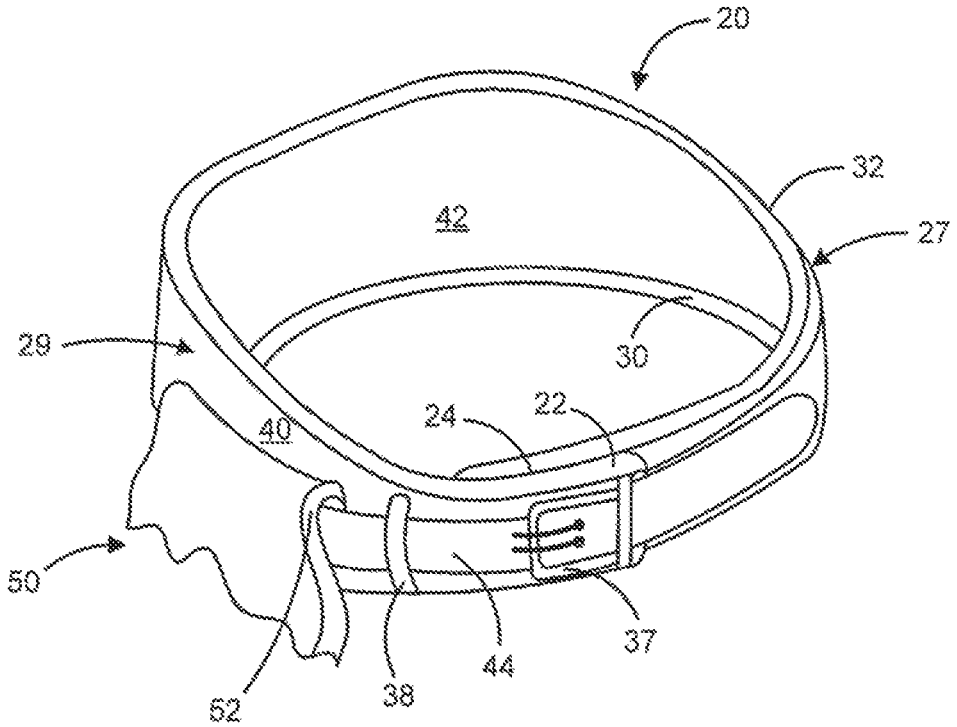
FIG. 1 illustrates a girdle and a tool bag attached thereto.

Referring to FIG. 1, the tool belt may comprise a girdle 20 which has a first outer end 22 and a second outer end 24. When in use, the ends 22, 24 overlap with one another. The girdle 20 includes a lateral or height dimension from a bottom edge 30 to a top edge 32 which varies about the circumference or linear run of the girdle 20. The lateral dimension in the center is greater than the lateral dimension at the ends 22, 24. The lateral dimension of the girdle 20 on the opposite sides 27, 29 is greater than the lateral dimension at the front thereof where the ends 22, 24 overlap. Typically the girdle 20 is formed from a rugged fabric material which is formed in dual, over layering layers with an edging stitched to connected the dual layers of fabric. Thus, edging is stitched about the outside perimeter or periphery of the girdle 20, and the girdle 20 is formed by a dual layer of rugged fabric material. The ends 22, 24 of the girdle may include Velcro or other material to secure the ends 22, 24 in a fixed position to resist relative movement. Other materials may likewise be used, as desired.

Integrally sewn onto the outside surface of the girdle 20 are a series of spaced apart open loops 38 for the receipt of a strap 44. The loops 38 are preferably positioned so that pockets, described below, which include a pocket noose 52, may be supported between the loops 38. The inside surface 42 of the girdle 20 is generally a smooth surface, which is comfortable to fit against the body of the user. The strip 44 fitted against outside surface 40 of the girdle 20 extends through the loops 38. The strap 44 is preferably constructed from a rugged material, such as leather, and includes a buckle 37 for connecting the opposite ends of the strap, and thus the opposite ends 22, 24 of the girdle 20 together. The strap 44 has a relatively narrower lateral height relative to the girdle 20. It is noted that the girdle and strap may be integrated components or separate components, as desired.

The pocket 50 is supported on the strap 44. Thus, for example, the pocket 50 may include the pocket noose 52 fitted onto the strap 44. Other interconnections may be used between the pocket 50 and the strap and/or girdle.

Figure 2:
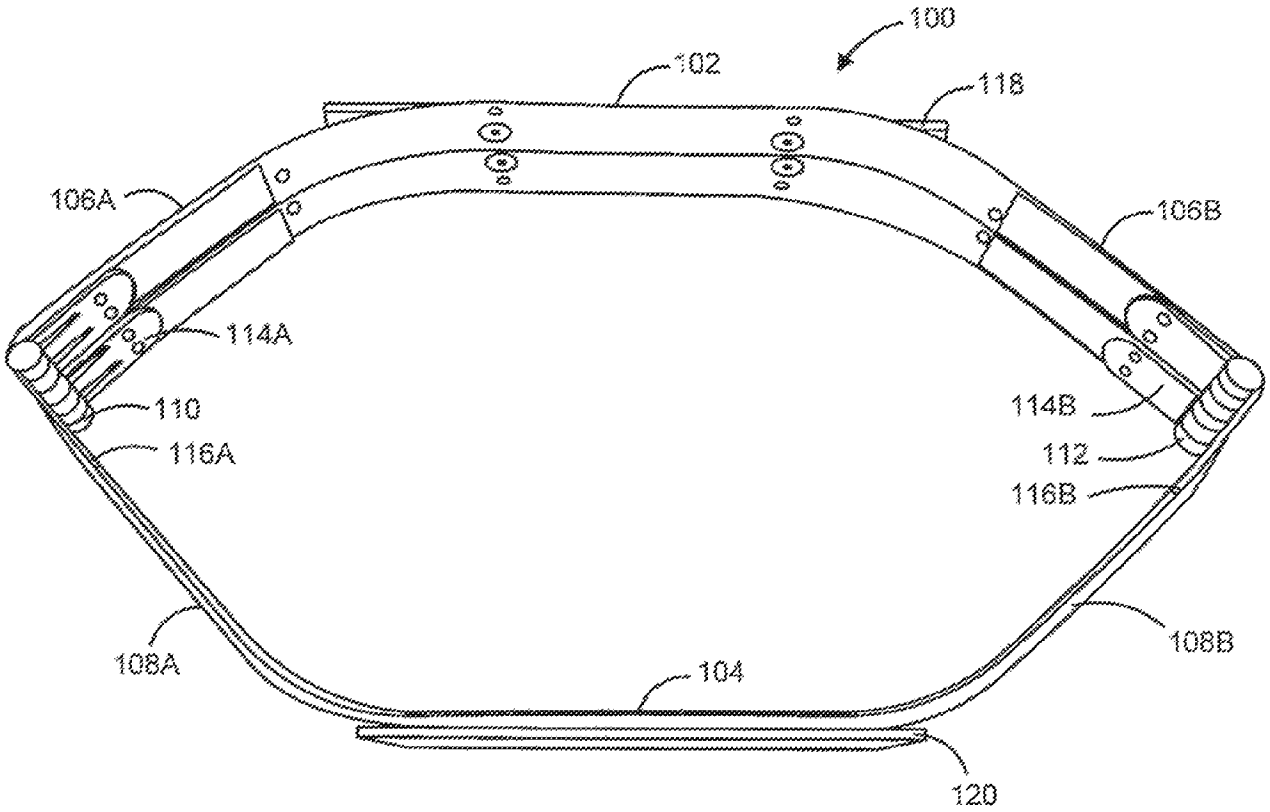
FIG. 2 illustrates a spring frame in an opened position for the tool bag.
Figure 3:
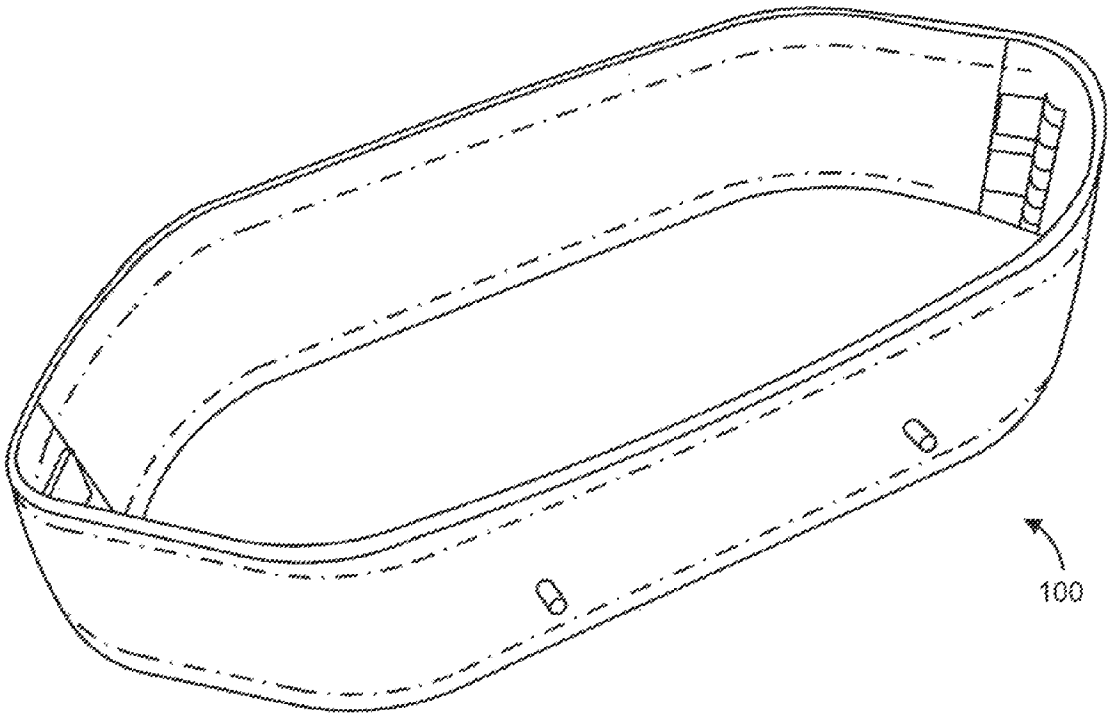
FIG. 3 illustrates the spring frame of FIG. 2 with a protective layer thereon.
Figure 4:
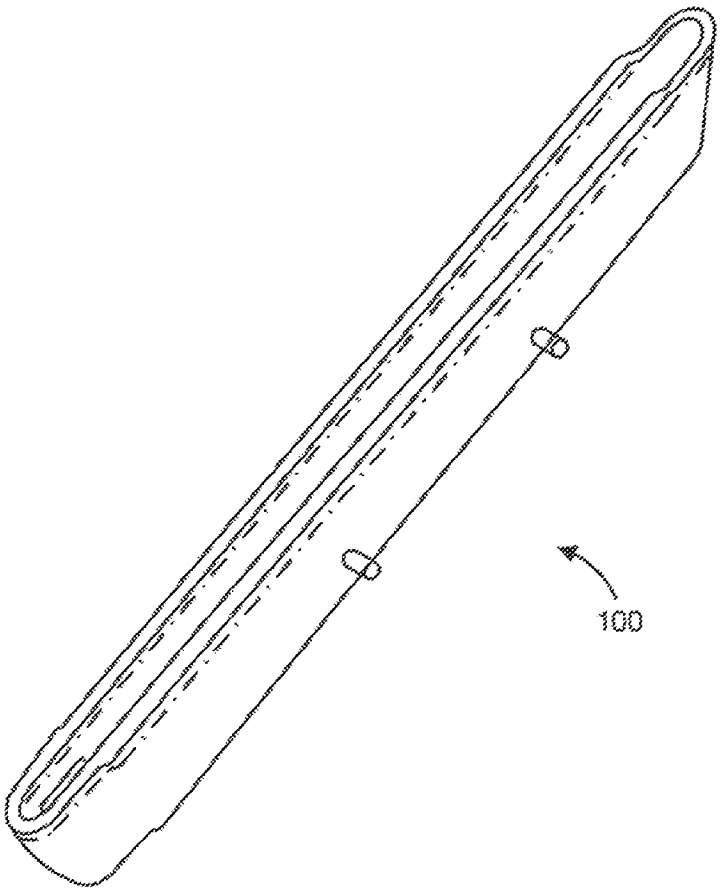
FIG. 4 illustrates the spring frame of FIG. 3 in a close position.

Referring to FIG. 2, the pocket 50 which may include one or more bags to store contents therein, may be constructed using one or more spring frames 100. The spring frames may be for example, facile springs, flex purse frames, flex frames, or otherwise. The spring frames 100 are preferably constructed from a flexible material, such as steel. The spring frames 100 may include a pair of opposing sides 102, 104 that are preferably substantially linear and parallel with one another. The opposing sides 102, 104 are interconnected to a corresponding pair of curved portions 106A, 106B, and 108A, 108B. The curved portions 106A, 106B, 108A, 108B are preferably substantially linear and parallel with one another when the spring frame 100 is closed. A pair of springs 110, 112 are interconnected to a corresponding pair of spring arms 114A, 114B, and 116A, 116B. To configure the spring frame 100 in an open position, the pair of opposing sides 102, 104 are separated from one another and the spring frame maintains itself in an open position without any further user interaction. To configure the spring frame 100 in a closed position, the pair of opposing sides 102, 104 are moved toward one another and the spring frame maintains itself in a closed position without any further interaction. Referring to FIG. 3, the spring frame 100 may be covered in a protective layer, such as wrapped in leather or other suitable material. Referring to FIG. 4, the spring frame 100 may be maintained in a closed position wrapped with a protective layer, if desired.

Figure 5:
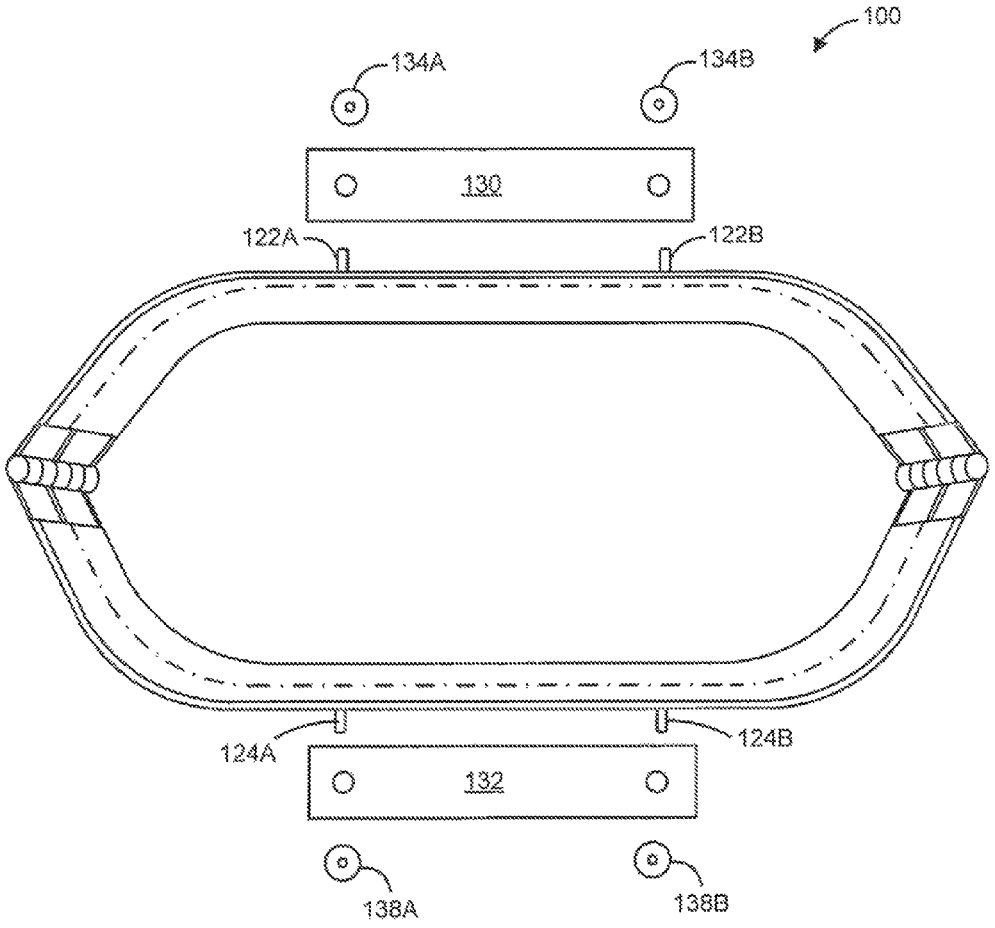
FIG. 5 illustrates the spring frame of FIG. 3 with a pair of plates to be attached thereto together with studs.

The spring frame 100 may include a pair of plates 118 and 120 secured to corresponding opposing sides 102, 104 of the spring frame 100. The plates 118 and 120 may be located within the protective layer. Referring to FIG. 5, a corresponding pair of studs 122A, 122B, and 124A, 124B may be affixed to the plates 118, 120. In this manner, the spring frame 100 includes additional structural integrity along the corresponding opposing sides 102, 104. Additionally, the corresponding pair of studs provide a structurally solid support onto which to attach additional spring frames for multiple pockets.

Figure 6:
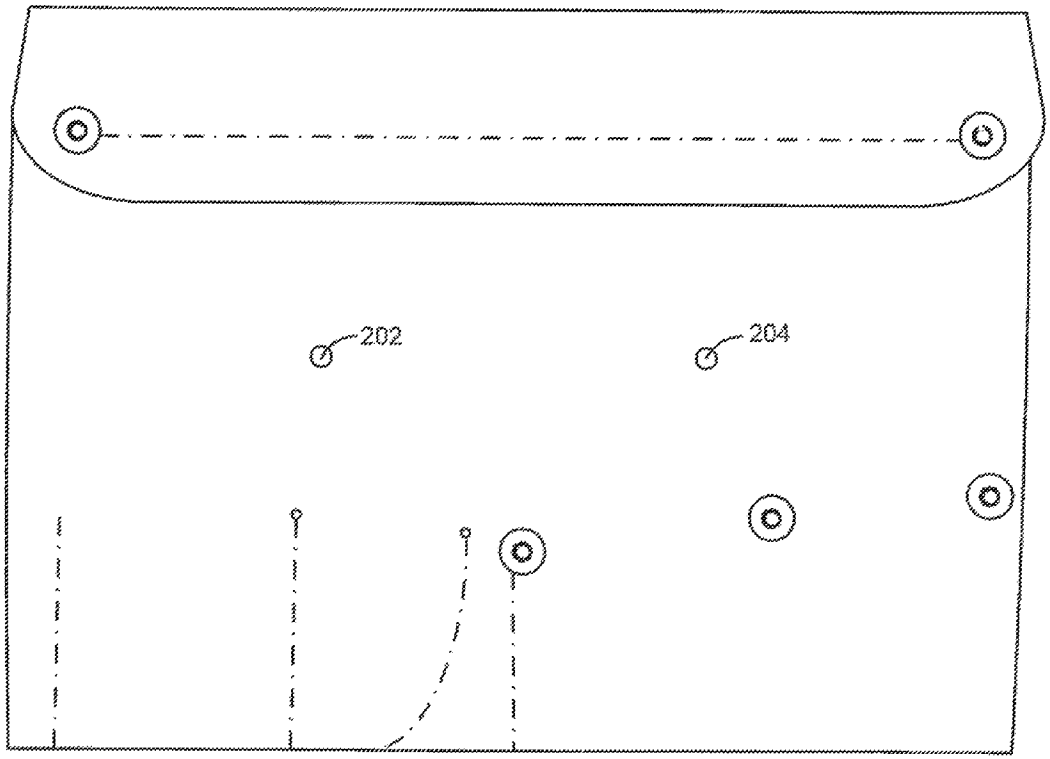
FIG. 6 illustrates the tool bag of FIG. 1 with a pair of openings defined therein.
Figure 7:
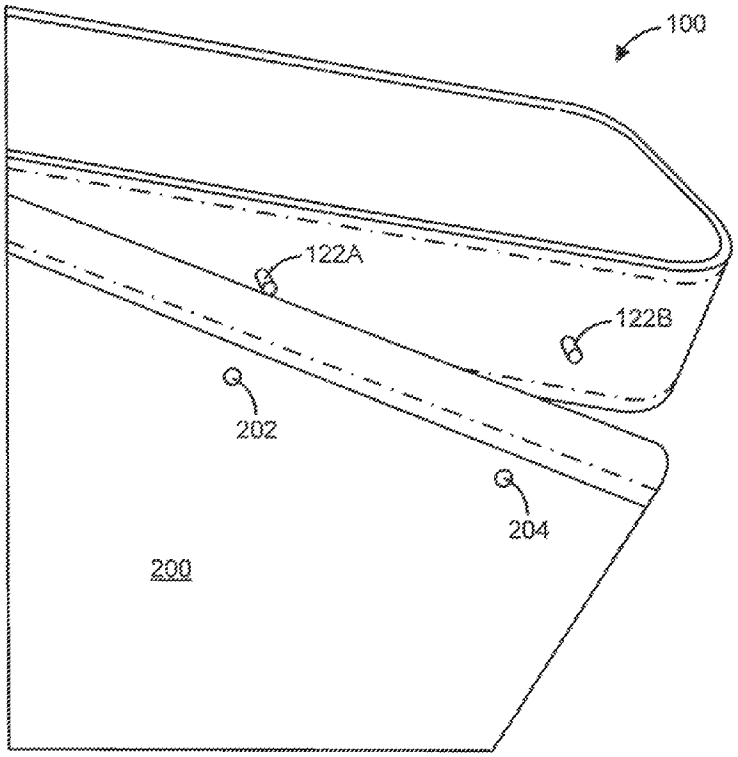
FIG. 7 illustrates the spring frame of FIG. 4 to be affixed to the tool bag of FIG. 6.
Figure 8:
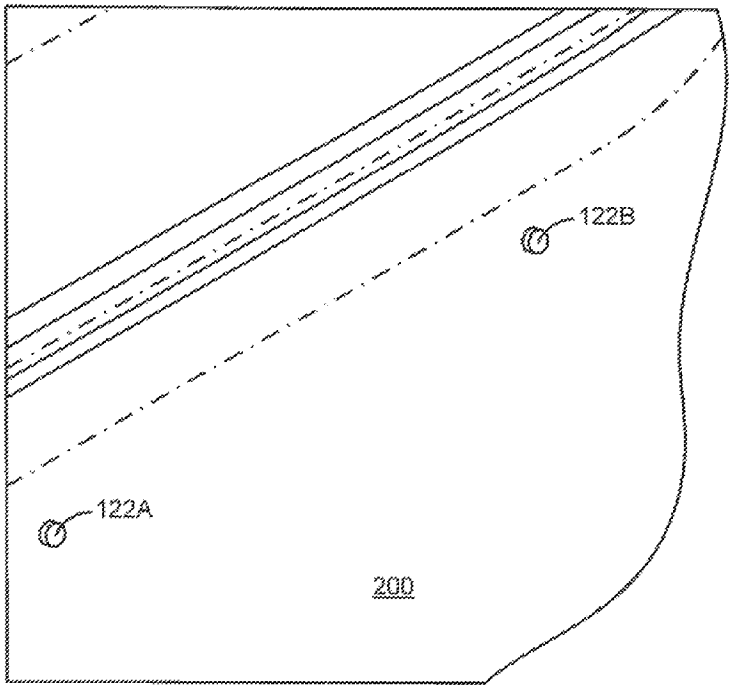
FIG. 8 illustrates the spring frame and the tool bag of FIG. 7 with the studs engaged with the openings of the tool bag.
Figure 9:
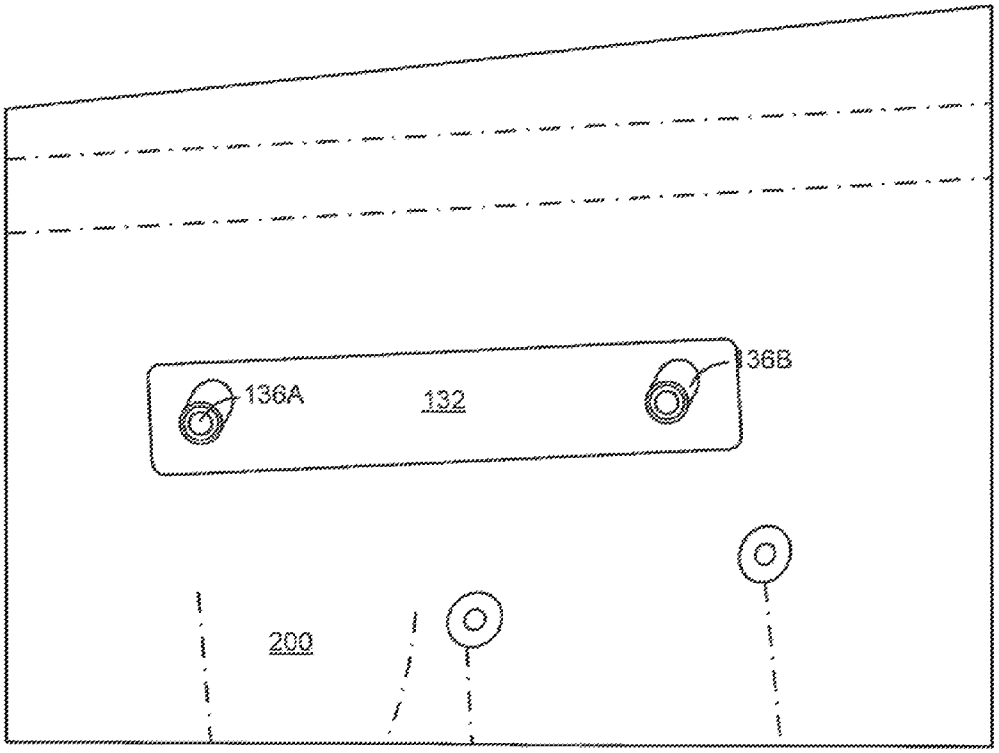
FIG. 9 illustrates the spring frame and the tool bag of FIG. 8 with the plate attached thereto.
Figure 10:
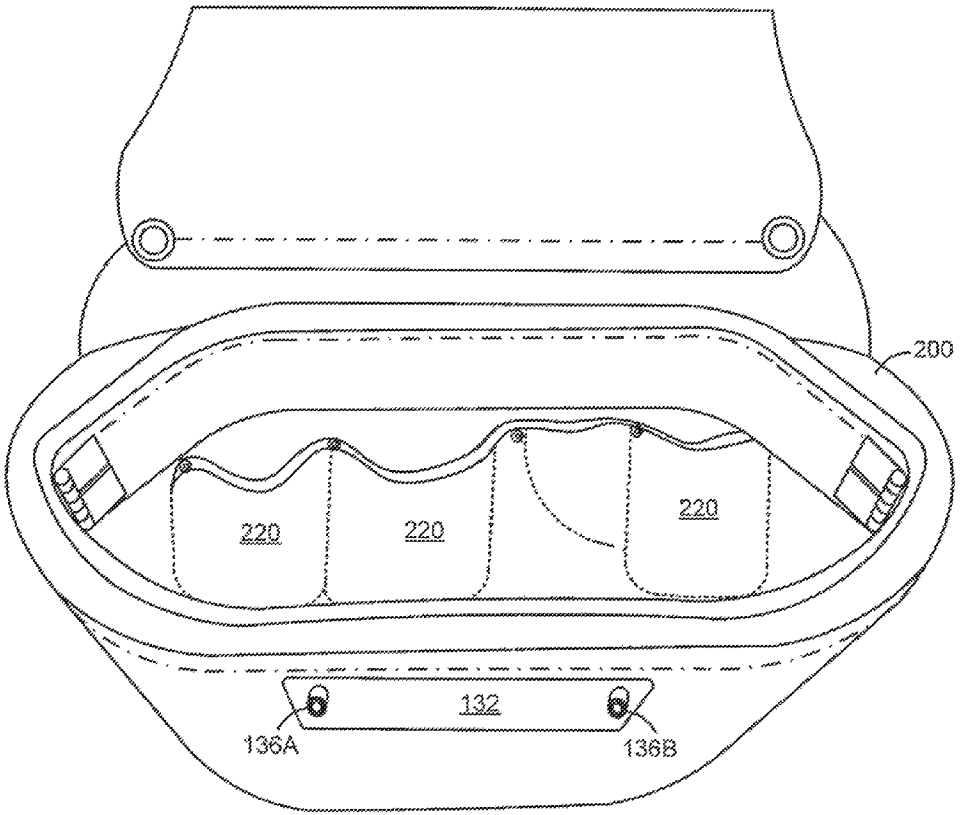
FIG. 10 illustrates the spring frame and the tool bag of FIG. 9 in the opened position.
Figure 11:
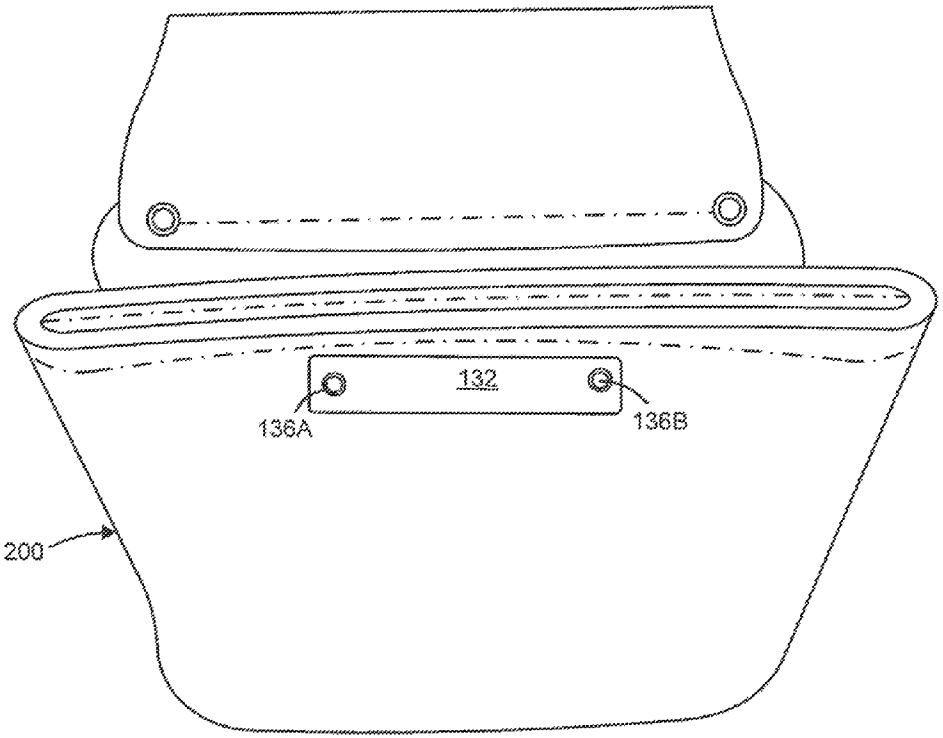
FIG. 11 illustrates the spring frame and the tool bag of FIG. 10 in the closed position.

Referring to FIG. 6, an open bag 200 may be secured to the spring frame 100 by defining a pair of openings therein 202, 204. Referring to FIG. 7, the pair of openings 202, 204 are sized to match the spacing of the pair of studs 122A, 122B and/or 124A, 124B. The spring frame 100 is preferable positioned within the opening defined by the bag 200 and the pair of studs 122A, 122B are positioned through the pair of openings 202, 204, as illustrated in FIG. 8. Referring to FIG. 9 (together with FIG. 5), a pair of plates 130, 132 may be supported by the corresponding pair of studs 122A, 122B, and 124A, 124B. The pair of plates 130, 132 may be secured to the bag by a corresponding pair of nuts 134A, 134B, and 136A, 136B. Referring to FIG. 10 and FIG. 11, in this manner, the exterior of the bag includes a plate suitable for providing additional structural integrity to the bag, in addition to providing a structural support for an additional bag. Additional pockets 220 may be included within the bag 200, as desired.

Figure 12:
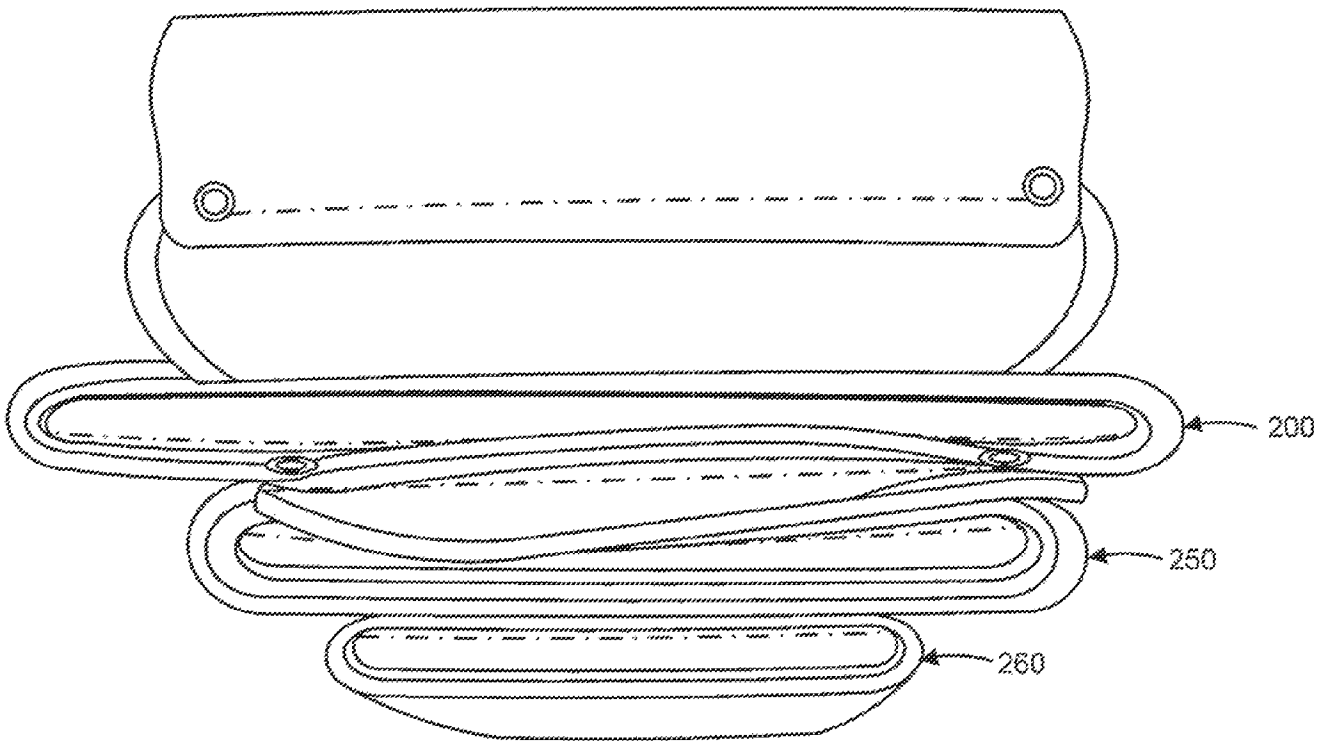
FIG. 12 illustrates a plurality of spring frames and tool bags having a large size, a medium size, and a small size affixed to one another.

Referring to FIG. 12, the bag 200 including the spring frame 100 may be interconnected with a second bag 250 that likewise includes an internal spring frame. The second bag 250 including its spring frame may be interconnected with a third bag 260 that likewise includes an internal spring frame. Preferably, each of the bags 200, 250, and 260 holds a smaller volume within, and also has a smaller width. In particular, the bag 200 is suitable for holding larger sized items, the bag 250 is suitable for holding medium size objects, and the bag 260 is suitable for holding small sized objects.

Figure 13:
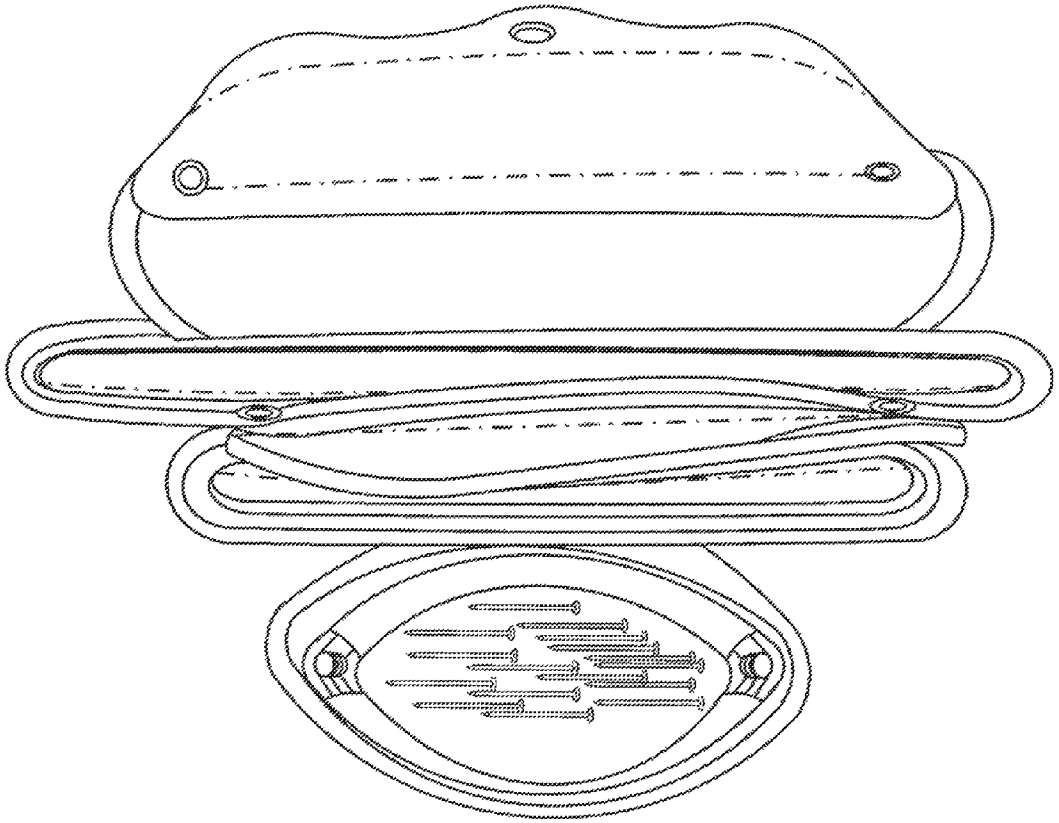
FIG. 13 illustrates the plurality of spring frames and tool bags of FIG. 12 with the small size bag in the opened position.

Referring to FIG. 13, the bag 200 and the bag 250 may be closed, with the bag 260 being open. In this manner, the items in the bags 200, 250 remain secured therein while the items in the bag 260 are readily accessible.

Figure 14:
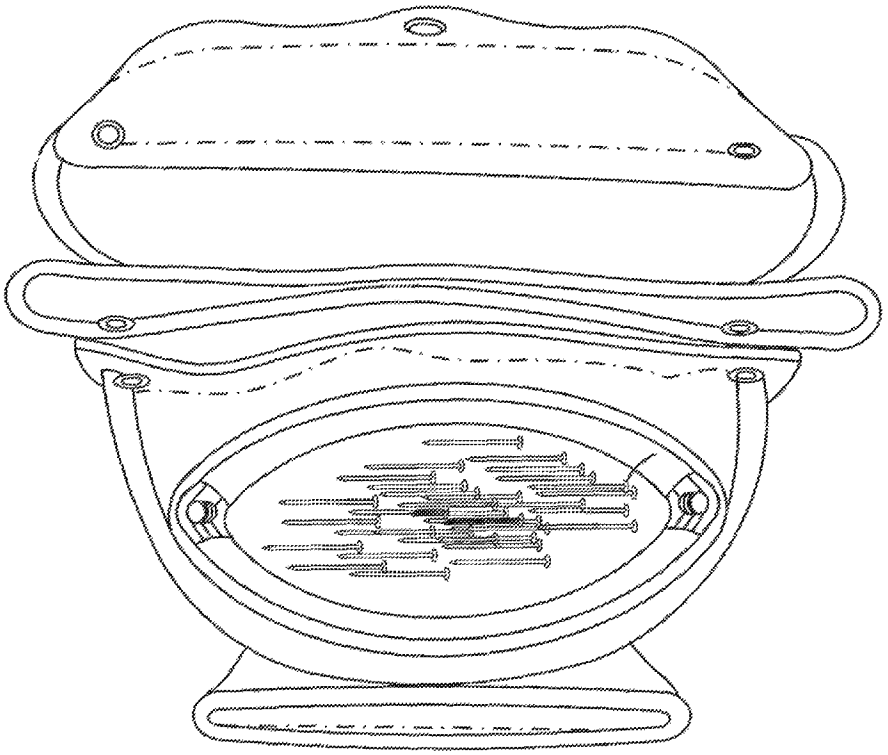
FIG. 14 illustrates the plurality of spring frames and tool bags of FIG. 12 with the medium size bag in the opened position.

Referring to FIG. 14, the bag 200 and the bag 260 may be closed, with the bag 250 being open. In this manner, the items in the bags 200, 260 remain secured therein while the items in the bag 250 are readily accessible.

Figure 15:
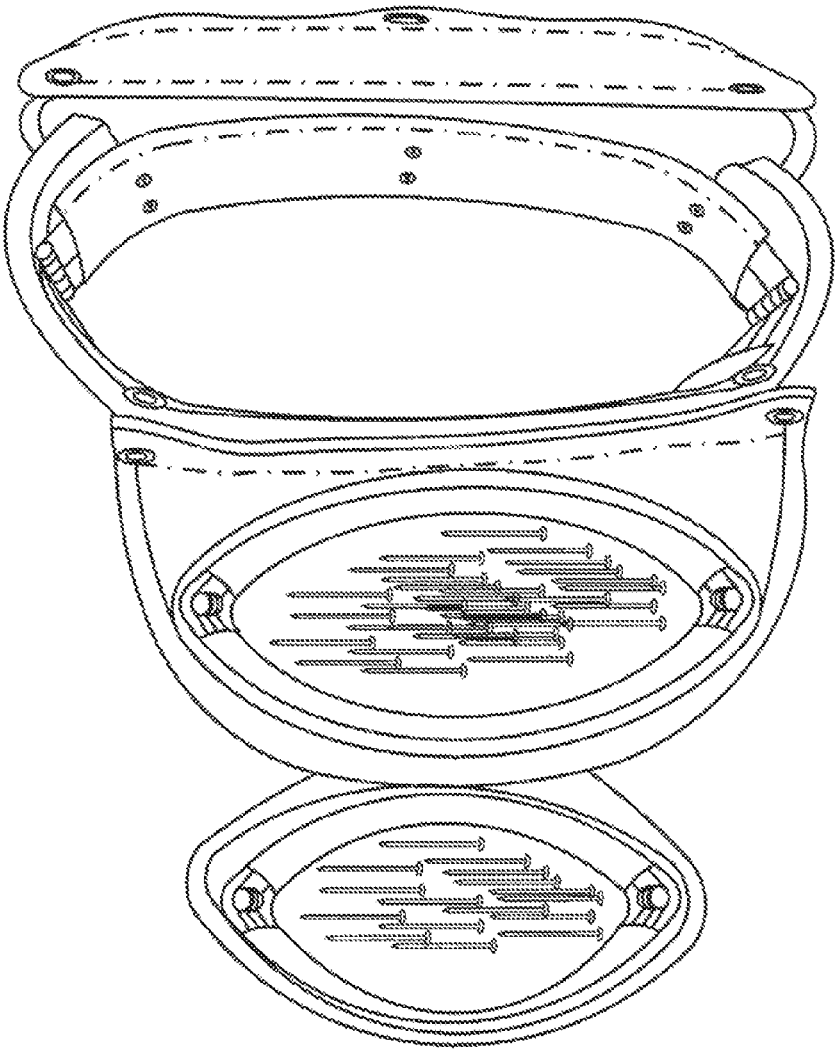
FIG. 15 illustrates the plurality of spring frames and tool bags of FIG. 12 with the small, medium, and large size bags in the opened position.

Referring to FIG. 15, the bags 200, 250, 260 may be open. In this manner, the items in the bags 200, 250, 260 are all readily accessible.

In general, one or more of the bags may be secured, and one or more of the bags may be open so that the contents therein are readily accessible. Also, the tool bag may be modified to include one bag, two bags, three bags, four bags, or more as desired.

Figure 16:
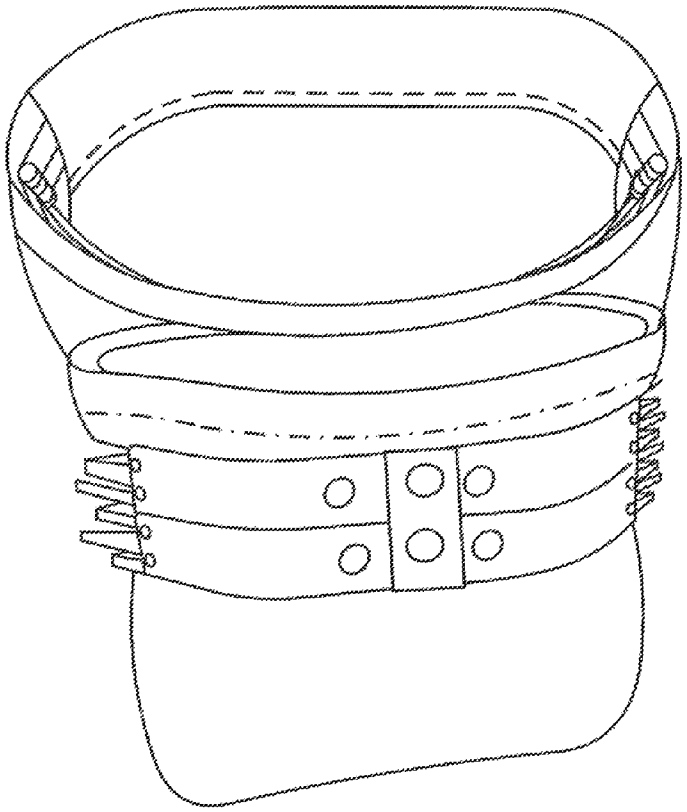
FIG. 16 illustrates the spring frame and tool bag with the spring frame on the external side of the bag.

Referring to FIG. 16, if desired one or more of the bags may include the spring frame on the exterior of the bag.

As it may be observed, the studs interconnected each pair of successively smaller bags may be closer together with one another, together with the openings in the bags and openings in the plates similarly being correspondingly closer with one another. The facing outer adjoining surfaces of the bags may include a plate therebetween to provide added stability, if desired. The facing outer adjoining surfaces of the bags may omit a plate therebetween and the respective bags are secured together by securing the interior plates to each other.

Figure 17:
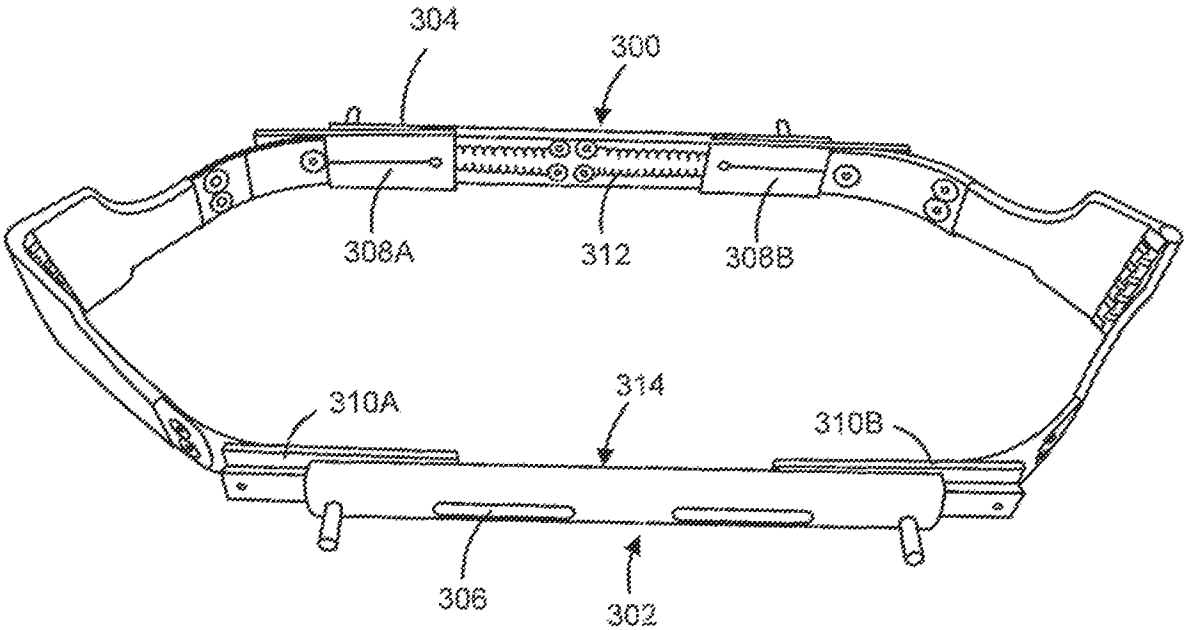
FIG. 17 illustrates a modified spring frame in an extended and opened position.

Referring to FIG. 17, in another embodiment the spring frame may include a pair of adjustable opposing sides 300 and 302. The sides 300, 302 may each include an outer bar 304, 306 that is slidably engaged with a corresponding pair of rails 308A, 308B, and 310A, 310B. A corresponding spring 312, 314 is maintained between the ends of the corresponding pair of rails 308A, 308B, and 310A, 310B by the bars 304, 306.

Figure 18:
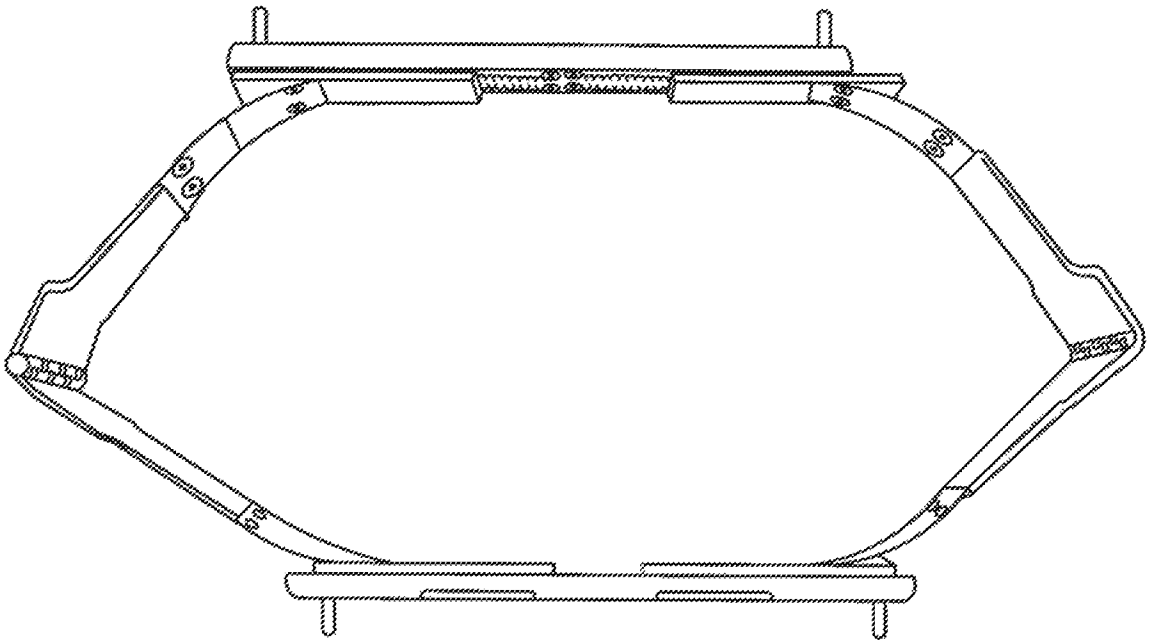
FIG. 18 illustrates the modified spring frame in a retracted and opened position.
Figure 19:
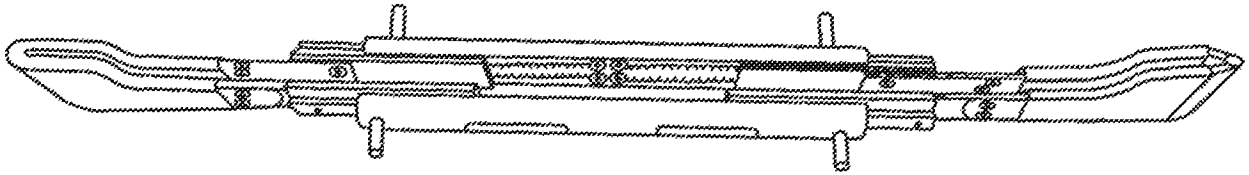
FIG. 19 illustrates the modified spring frame in the extended and closed position.
Figure 20:
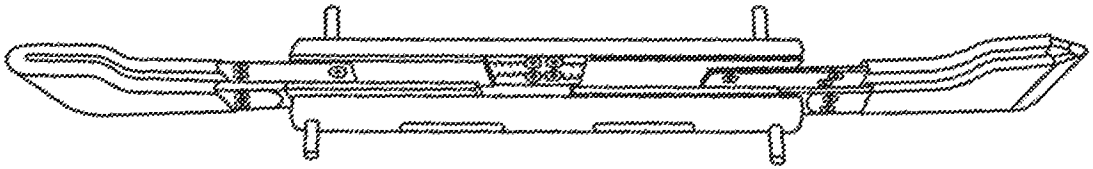
FIG. 20 illustrates the modified spring frame in the retracted and closed position.

The springs 312, 314 provide an outwardly extending pressure on the ends of the spring frame to maintain the spring assembly at a full extension. The fully extended spring assembly may be engaged with a correspondingly sized bag of the tool belt assembly. Referring to FIG. 18, for smaller bags the spring frame may be shortened by compressing the spring so that the overall length of the spring frame is decreased. The compressed spring assembly may be engaged with a correspondingly sized bag of the tool belt assembly. Referring to FIG. 19, the extended spring assembly may be closed. Referring to FIG. 20, the shortened spring assembly may be closed. In this manner, the same single spring frame assembly may be used for different sized bags.

In another embodiment, the spring frame may be included within the opening defining a shot shell bag.

In another embodiment, the spring frame may be included within a tool bag. The tool bag typically has a large central opening (with a spring frame included therein) and a set of various sized pouches around substantially the entire periphery of the tool bag.

In another embodiment, one or more of the frames may be secured to one or more of the pouches by sewing.

In another embodiment, one or more of the frames may be secured with rivets. If desired, the studs and plates may be omitted.

In another embodiment, the spring frame may be included within a bucket tool bag. The bucket tool bag typically has an upper portion that is suitable for being supported by the upper rim of the bucket.

It is to be understood that the claims are not limited to the precise configuration and components illustrated above. Various modifications, changes and variations may be made in the arrangement, operation and details of the systems, methods, and apparatus described herein without departing from the scope of the claims.

I claim:

1. A tool pocket assembly comprising:

(a) a tool belt;

(b) a pocket system supported by said tool belt, wherein said pocket system includes a first pocket and a second pocket;

(c) said first pocket includes a first spring frame integrated therewith that includes a first position that closes a top portion of said first pocket and a second position that opens a top portion of said first pocket, where said first spring frame includes a first side and a second side that are movable between said first position and said second position, where said first side of said first spring frame is wrapped in a first protective layer, where said second side of said first spring frame is wrapped in a second protective layer, where said first side of said first spring frame defines a first pair of openings therein generally centered along the length of said first side of said first spring frame, where said second side of said first spring frame defines a second pair of openings therein generally centered along the length of said second side of said first spring frame, where said first spring frame is only maintained within said first pocket by a first pair of attachment members extending through said first pair of openings and a second air of attachment members extending through said second pair of openings, where said first protective layer and said second protective layer are in face to face arrangement with an interior surface of said first pocket;

(d) said second pocket includes a second spring frame integrated therewith that includes a first position that closes a top portion of said second pocket and a second position that opens a top portion of said second pocket, where said second spring frame includes a first side and a second side that are movable between said first position and said second position, where said first side of said second siring frame is wrapped in a third protective layer, where said second side of said second spring frame is wrapped in a fourth protective layer, where said first side of said second spring frame defines a third pair of openings therein generally centered along the length of said first side of said second spring frame, where said second side of said second spring frame defines a fourth pair of openings therein generally centered along the length of said second side of said second spring frame, where said second spring frame is only maintained within said second pocket by a third pair of attachment members extending through said third pair of openings and a fourth pair of attachment members extending through said fourth pair of openings, where said third protective layer and said fourth protective layer are in face to face arrangement with an interior surface of said second pocket;

(e) said first pocket is attached to and supported by said tool belt;

(f) said second pocket is attached to and supported by said first pocket at a location further distant from said tool belt than said first pocket, where said second pocket is said attached to said first pocket by said second pair of attachment members through said second pair of openings of said second side of said first spring frame and said third pair of openings of said first side of said second spring frame, where said second pocket is not attached to said first pocket by any other structure than said third pair of attachment members.

2. The tool pocket assembly of claim 1 further comprising said tool belt includes a first outer end and a second outer end.

3. The tool pocket assembly of claim 2 wherein said ends are overlapping with one another and include a securement mechanism to secure said first out end and said second outer end to one another.

4. The tool pocket assembly of claim 3 wherein said tool belt includes a lateral height which varies around the linear run of said tool belt.

5. The tool pocket assembly of claim 4 wherein a center region of said tool belt has a substantially greater said lateral height than said lateral height at either portions of said first outer end and said second outer end.

6. The tool pocket assembly of claim 5 wherein said tool belt includes at least two layers thereof with stitching about the outer periphery of the said tool belt.

7. The tool pocket assembly of claim 6 wherein said tool belt further comprises a plurality of spaced apart open loops on the exterior surface thereof.

8. The tool pocket assembly of claim 7 wherein the interior surface of said tool belt is substantially smooth.

9. The tool pocket assembly of claim 8 further comprising a strap extending through said open loops that includes a fastening device to secure a first end of said strap to a second end of said strap.

10. The tool pocket assembly of claim 9 wherein said strap has a lateral height that is less than said later height of said tool belt.

11. The tool pocket assembly of claim 1 wherein said first spring frame includes a pair of opposing sides that are substantially linear and parallel with one another.

12. The tool pocket assembly of claim 11 wherein said first spring frame includes a pair of curved portions that are substantially linear and parallel with one another when said first spring frame is in said second position.

13. The tool pocket assembly of claim 12 wherein said a pair of curved portions are interconnected to said pair of opposing sides with detent spring hinges.

14. The tool assembly of claim 13 wherein said pair of opposing sides maintains said second position without further interaction.

15. The tool assembly of claim 14 wherein said pair of opposing sides are wrapped in a protective layer.

16. The tool pocket assembly of claim 1 wherein said second pair of attachment members and said third pair of attachment members are a pair of attachment members.

17. A tool pouch assembly comprising:

(a) a pouch system;

(b) said pouch system includes a first pouch and a second pouch;

(c) said first pouch includes a first spring frame integrated there with that includes a first position that closes a top portion of said first pouch and a second position that opens a top portion of said first pouch, where said first spring frame includes a first side and a second side that are movable between said first position and said second position, where said first side of said first spring frame is wrapped in a first protective layer, where said second side of said first spring frame is wrapped in a second protective layer, where said first side of said first spring frame defines a first pair of openings therein generally centered along the length of said first side of said first spring frame, where said second side of said first spring frame defines a second pair of openings therein generally centered along the length of said second side of said first spring frame, where said first spring frame is only maintained within said first pouch by a first pair of attachment members extending through said first pair of openings and a second pair of attachment members extending through said second pair of openings, where said first protective layer and said second protective layer are in face to face arrangement with an interior surface of said first pocket;

(d) said second pouch includes a second spring frame integrated therewith that includes a first position that closes a top portion of said second pouch and a second position that opens a top portion of said second pouch, where said second spring frame includes a first side and a second side that are movable between said first position and said second position, where said first side of said second spring frame is wrapped in a third protective layer, where said second side of said second spring frame is wrapped in a fourth protective layer, where said first side of said second spring frame defines a third pair of openings therein generally centered along the length of said first side of said second spring frame, where said second side of said second spring frame defines a fourth pair of openings therein generally centered along the length of said second side of said second spring frame, where said second spring frame is only maintained within said second pouch by a third pair of attachment members extending through said third pair of openings and a fourth pair of attachment members extending through said fourth pair of openings, where said third protective layer and said fourth protective layer are in face to face arrangement with an interior surface of said second pouch;

(e) said first pouch adapted to be attached to and supported by a tool belt;

(f) said second pouch is attached to and supported by said first pouch at a location further distant from said tool belt than said first pouch.

18. The pouch assembly of claim 17 wherein said first side and said second side of said first spring frame are substantially linear and parallel with one another.

19. The pouch assembly of claim 18 wherein said pair of steel bands of steel bands are interconnected to said opposing sides by a spring hinge at each end.

20. The pouch assembly of claim 19 wherein said pair of opposing sides maintains said second position without further interaction.

* * * * *